US006334672B1

(12) United States Patent
Matsui et al.

(10) Patent No.: US 6,334,672 B1
(45) **Date of Patent: *Jan. 1, 2002**

(54) INKJET RECORDING HEAD HAVING A DRIVING SOURCE ATTACHED BY A CHAMFERED ADHESIVE LAYER

(75) Inventors: Naoki Matsui, Sakai; Hisashi Takata, Takatsuki, both of (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/843,873

(22) Filed: Apr. 17, 1997

(30) Foreign Application Priority Data

Apr. 18, 1996 (JP) ..... 8-096563

(51) Int. Cl.[7] ..... B41J 2/045
(52) U.S. Cl. ..... 347/70; 347/94
(58) Field of Search ..... 347/70, 71, 72, 347/94

(56) References Cited

U.S. PATENT DOCUMENTS 5,381,171 A * 1/1995 Hosono et al. ..... 347/72
5,896,150 A * 4/1999 Kobayashi et al. ..... 347/71

FOREIGN PATENT DOCUMENTS

| | | |
|---|---|---|
| JP | 2-187351 | 7/1990 |
| JP | 4-59254 | 2/1992 |
| JP | 7-60960 | 3/1995 |

* cited by examiner

*Primary Examiner*—Max Noori
*Assistant Examiner*—C. Dickens
(74) *Attorney, Agent, or Firm*—McDermott, Will & Emery

(57) ABSTRACT

The present invention relates to an inkjet recording head, which includes an ink cavity and an ink discharge port, a mounting member covering the ink cavity, an oscillating member, and a substrate to support the oscillating member. Various parts of the inkjet recording head are held together with adhesive. In attaching the piezoelectric element to the mounting member, opposing surfaces of the oscillating member and the mounting member are fixed to one another with adhesive. Then, the two members are pressed together, thereby causing excessive adhesive to emerge from between opposing surfaces of the oscillating member and the mounting member. The emerged adhesive is formed into chamfer to provide the oscillating member and the mounting member with areas of attachment that extend beyond the area of attachment that exists between the opposing surfaces.

22 Claims, 11 Drawing Sheets

| adhesive thicknesses | amount of displacement | | displacement loss | |
|---|---|---|---|---|
| | contact area (point a) | average of contact areas | average | percentage |
| 5 | 0.5685 | 0.5542 | 0.0143 | 2.5 |
| 25 | 0.5690 | 0.5410 | 0.0280 | 4.9 |
| 50 | 0.5691 | 0.5262 | 0.0429 | 7.5 |

FIG. 2 with extruded adhesive

| adhesive thicknesses (μm) | extrusion cross section area | continuous oscillations | |
|---|---|---|---|
| | | with shaping a curved surface (radius of curvature) | without shaping a curved surface |
| 5 | 2.15E-03 | 8.90E+08 (10μm) | 6.00E+06 |
| | 5.37E-03 | 1.04E+09 or more (25μm) | 1.44E+07 |
| | 8.58E-03 | 1.04E+09 or more (40μm) | 3.46E+08 |
| | 1.29E-02 | 1.04E+09 or more (60μm) | 1.04E+09 or more |
| | 1.72E-02 | 1.04E+09 or more (80μm) | 1.04E+09 or more |

FIG. 9(a)

without extruded adhesive

| adhesive thicknesses (μm) | continuous oscillations |
|---|---|
| 5 | 2.40E+06 |
| 25 | 3.46E+08 |
| 50 | 1.04E+09 |

FIG. 9(b)

INKJET RECORDING HEAD HAVING A DRIVING SOURCE ATTACHED BY A CHAMFERED ADHESIVE LAYER

BACKGROUND OF THE INVENTION

The present invention relates to an inkjet recording head that applies pressure to eject ink accommodated in an ink cavity by deforming a piezoelectric element in accordance with input signals.

As depicted in FIG. 1, one known example of a drop-on-demand (DOD) type inkjet recording head comprises, a channel plate 10 having an ink cavity 12 and ink discharge port 14, a panel 16 covering the ink cavity 12, a piezoelectric element 18, a substrate 20 to support piezoelectric element 18, and an adhesive 24 for attaching the piezoelectric element 18 to the panel 16. In this recording head, the ink 22, which is accommodated in the ink cavity 12, is subjected to pressure so as to be discharged from the ink discharge port 14 via the deformation of panel 16 in accordance with the deformation of piezoelectric element 18. As a result, it is necessary that the deformation of piezoelectric element 18 is reliably transmitted to the panel 16, and subsequently, to the ink 22 accommodated in the ink cavity 12. Therefore, the piezoelectric element 18 is fixedly attached to panel 16 by an adhesive 24.

The above-described inkjet recording head, however, requires a degree of durability so that the piezoelectric element 18 does not separate from the panel 16 under continuous oscillation, for example, 4 KHz per 80 hrs (about $1\times10^9$) or more. Therefore, such an inkjet recording head has a disadvantage because sufficient durability cannot be obtained simply by an application of an adhesive between the piezoelectric element 18 and the panel 16.

The inkjet recording head's durability can be increased to a certain degree by increasing the thickness of the adhesive 24. However, this is not advantageous because the deformation of piezoelectric element 18 is absorbed by the adhesive 24 when the thickness of adhesive 24 is increased. Consequently the discharge force and pressure applied to ink 20 are reduced.

FIG. 2 is a table that shows the results of analysis of the relationship between displacement loss and adhesive thickness and amount of displacement loss using a finite element method. In particular, the table shows the amount of displacement for various thicknesses of adhesive at the contact area (point a, FIG. 1) between the adhesive 24 and the panel 16, and the average amount of displacement at other contact areas (center: point b; edge: point c; midpoint between point b and point c: point d) between the adhesive 24 and the panel 16. Also, FIG. 2 shows the percentage of displacement loss relative to the amount of displacement loss of the panel, and the average amount of displacement loss of the piezoelectric element at various adhesive thicknesses (5, 25, and 50 $\mu$m). As can be clearly understood from Table 1, displacement loss increases in conjunction with the increase in the adhesive thickness, thereby reducing the discharge force of ink 22. (The aforesaid analysis assumes that the adhesive has a Young's modulus of 30 kgf/cm$^2$.)

SUMMARY OF THE INVENTION

The inkjet recording head of the present invention has an oscillating member attached to a mounting member by an application of adhesive to the opposing surfaces of these members, wherein the adhesive on the external surfaces of the oscillating member and the mounting member forms a chamfer.

Furthermore, the inkjet recording head of the present invention is formed attaching an oscillating member to a mounting member adheres an oscillating member and mounting member by applying adhesive to at least a surface of the oscillating member or the mounting member, and thereafter pressing together the oscillating member and the mounting member so as to cause adhesive to emerge from the adhering surfaces to attach the members together.

According to the aforesaid inkjet recording head, opposed surfaces of an oscillating member and a mounting member are fixed to one another with adhesive, and a chamfer is formed in the adhesive that emerges from between the surfaces of the oscillating member and the mounting member at the adjacent external surfaces, so that the oscillating member and the mounting member have areas of attachment that extend beyond the area of attachment that exists between the opposed surfaces. This arrangement provided an advantage in that the adhesion strength and separation resistance between the oscillating member and the mounting member are improved. Furthermore, the absorption of oscillation of the oscillating member by the adhesive is suppressed to a lower limit by reducing the thickness of the adhesive by the aforesaid arrangement.

The invention itself, together with further objects and attendant advantages, will best be understood by reference to the following detailed description taken in conjunction with the accompanying figures.

BRIEF DESCRIPTION OF THE DRAWINGS

FIG. 2 is a table showing the results of analysis of the relationship between displacement loss and adhesive thickness and amount of displacement loss using a finite element method.

FIGS. 9(*a*) and 9(*b*) are tables showing the results of continuous durability tests.

DESCRIPTION OF THE PREFERRED EMBODIMENTS

The preferred embodiments of the present invention are described hereinafter with reference to the accompanying drawings.

Figure 1:
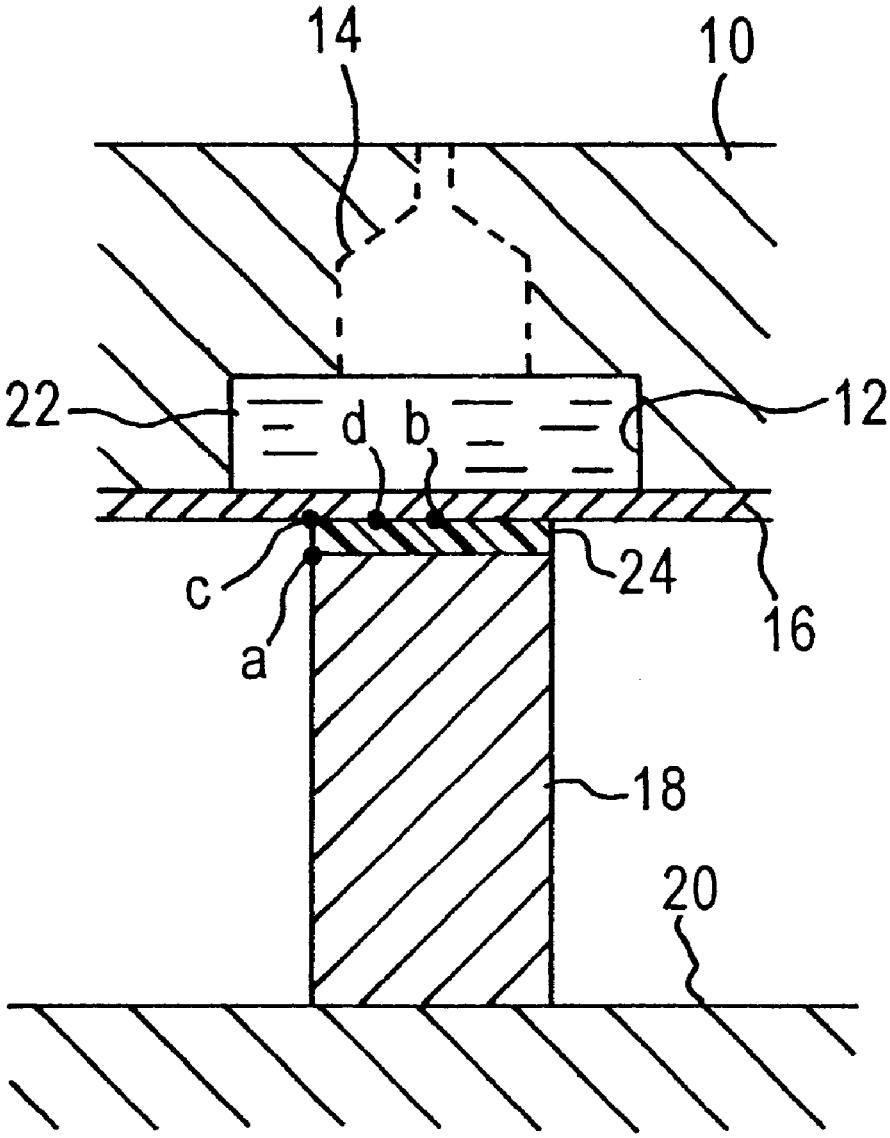
FIG. 1 (PRIOR ART)
FIG. 1 is a partial section view of a conventional inkjet recording head.
Figure 3:
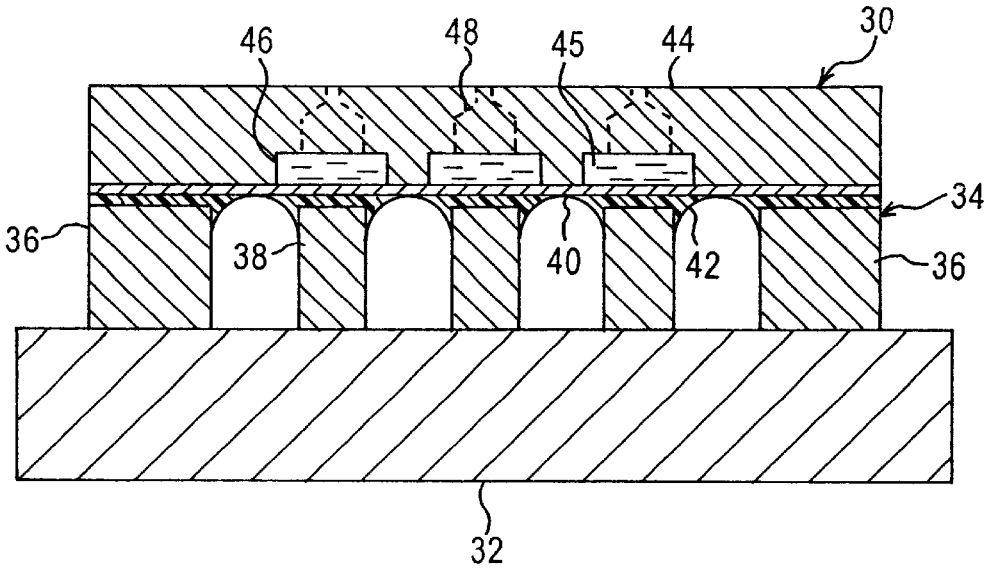
FIG. 3 is a section view of an inkjet recording head of an embodiment of the present invention.
Figure 4:
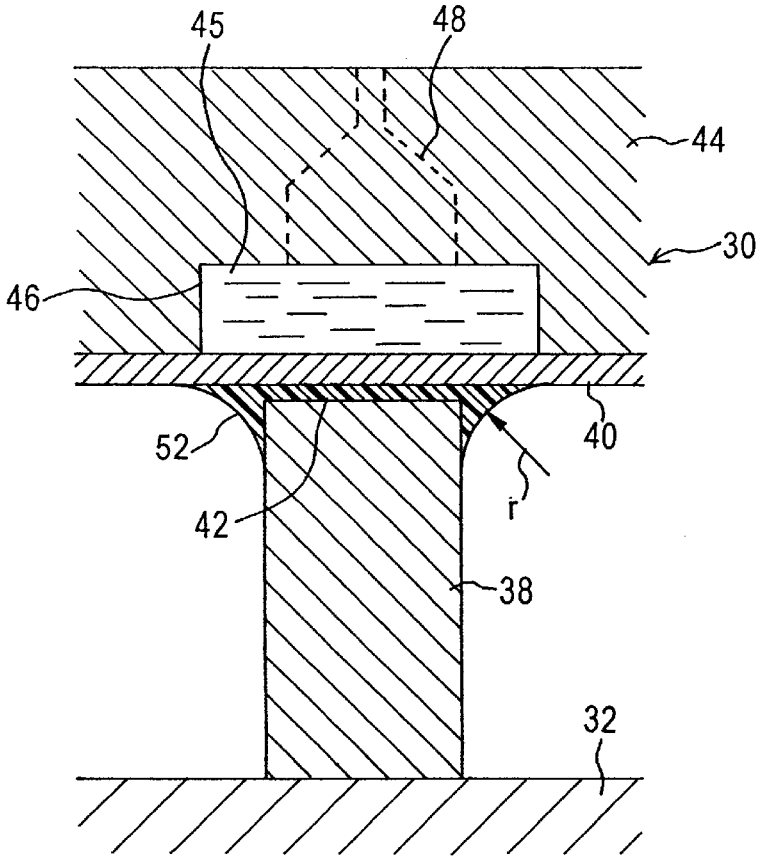
FIG. 4 is a partial enlarged section view of FIG. 3.

FIG. 3 is an enlarged section view of a DOD-type inkjet recording head 30, and FIG. 4 is a partial enlarged section view of the recording head 30. In recording head 30, a piezoelectric element 34, which is formed of piezoelectric material, is fixedly attached to a substrate 32, which is formed of a non-piezoelectric material. Piezoelectric element 34 comprises bilateral substrates or support members 36, and a plurality of piezo-actuators 38 arranged with an equidistant spacing between said substrates 36. Each piezo-actuator 38 has electrodes (not illustrated) disposed on the top and bottom surfaces thereof, and is subjected to a polarization process in the opposite direction of said electrodes, so as to be deformed when a voltage is applied between the electrodes. A panel or mounting member 40 is provided above the piezoelectric element 34. The support members 36 and the piezoelectric element-actuators 38 are fixedly attached to the panel 40 by an adhesive 42. A channel plate 44, comprising a non-piezoelectric material, is fixedly attached on the panel 40. The channel plate 44 is provided with an ink cavity or cutout 46 to accommodate or hold ink 45 in an area facing the piezoactuator 38. The bottom of the ink cavity 46 is closed by panel 40. The channel plate 44 is also provided with a nozzle 48 to discharge the ink 45 accommodated in each ink cavity 46.

In the inkjet recording head of the aforesaid construction, a piezo-actuator 38 is deformed when a voltage is applied between its electrodes, such that a panel area of the panel 40 in contact with said piezo-actuator 38 is bent toward ink cavity 46. As a result, the ink 45 held in said ink cavity 46 is subjected to pressure and caused to be discharged from a nozzle 48.

Figure 5A:
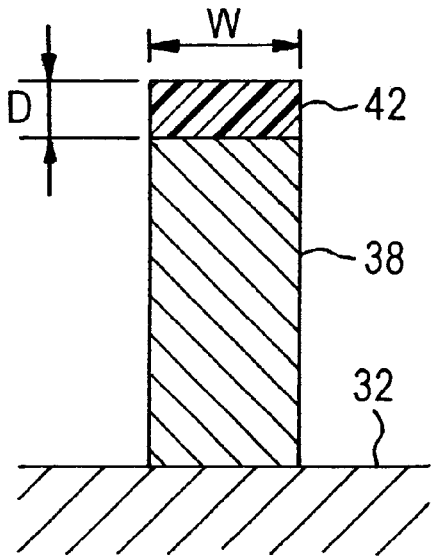
FIGS. 5(*a*) and 5(*b*) illustrate the method of adhering a piezo-actuator to a panel.
Figure 5B:
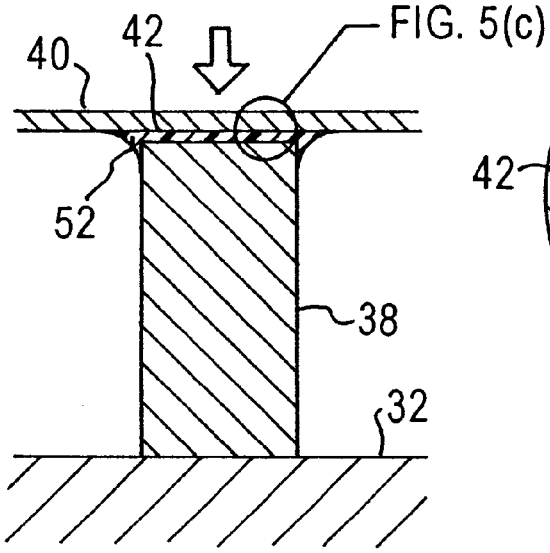
Figure 5C:
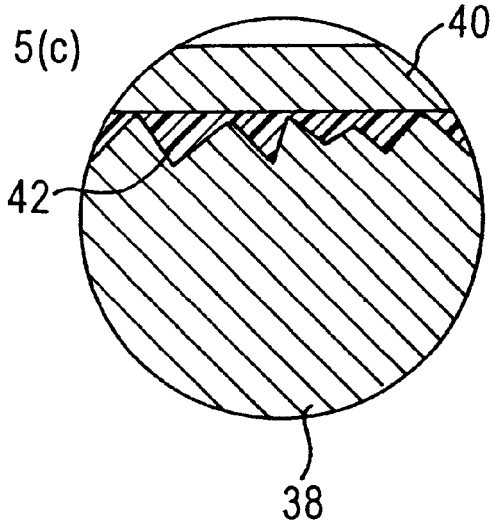

The bond between piezo-actuator 38 and panel 40 is described below with reference to FIGS. 5(*a*) and 5(*b*). The bond between a piezo-actuator 38 and the panel 40 is accomplished by applying a predetermined amount of adhesive 42 to the surface of piezo-actuator 38 facing panel 40 by a method, such as for example, screen printing, pad printing or the like. The amount of adhesive 42 that is applied is described later with reference to FIG. 6. The panel 40 is pressed against piezo-actuator 38 until any surplus adhesive 42 emerges from between the panel 40 and the piezo-actuator 38. The thickness of adhesive 42 between the piezo-actuator 38 and the panel 40 can be set below the surface roughness of a piezo-actuator 38 (i.e., normally 3 to 5 $\mu$m).

The extruded adhesive, which emerges from between panel 40 and piezo-actuator 38, forms a chamfer by a method described later, so as to form a concave curved surface. When the cross section of the shaped curved surface is assumed to be a circular arc, the radius r of the curved surface is desirably 3 to 200 $\mu$m. This radius r is desirably less than one half the distance between adjacent piezoelectric elements, i.e., less than one half the height of the piezoelectric element.

Figure 6A:
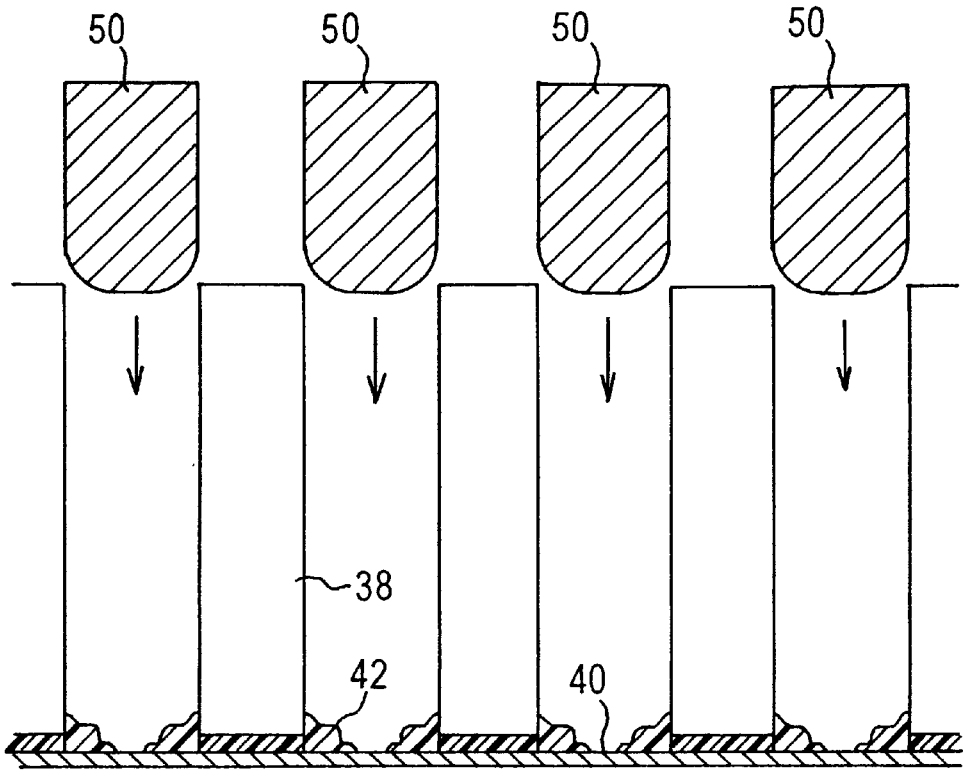
FIGS. 6(*a*) and 6(*b*) illustrate a method of shaping extruded adhesive into a curved surface.
Figure 6B:
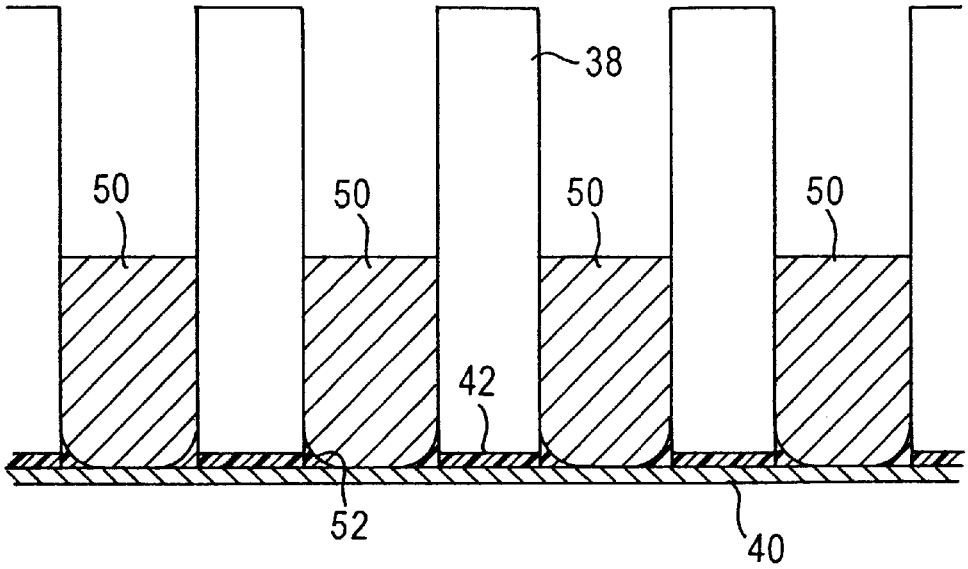

The shaping of the extruded adhesive may be accomplished by finishing the concave curved surface on the exterior side of the point angle with a shaping fixture 50 (FIGS. 6(*a*) and 6(*b*)). Prior to applying a shaping fixture to the adhesive, the shaping fixture is subjected to a processing to achieve excellent separation characteristics or is coated with a fluororesin or the like,which has excellent separation characteristics, at least on the parts of the fixture that will contact the adhesive.

As illustrated in FIGS. 6(*a*) and 6(*b*), the shaping fixture 50 is pushed toward the extruded adhesive to shape a desired curvature 52.

Alternatively, vibration and/or centrifugal force may be applied to a piezo-actuator 38 that has been attached to a panel 40 to achieve similar shaping, depending on the surface tension and viscosity of the adhesive used.

Figure 7:
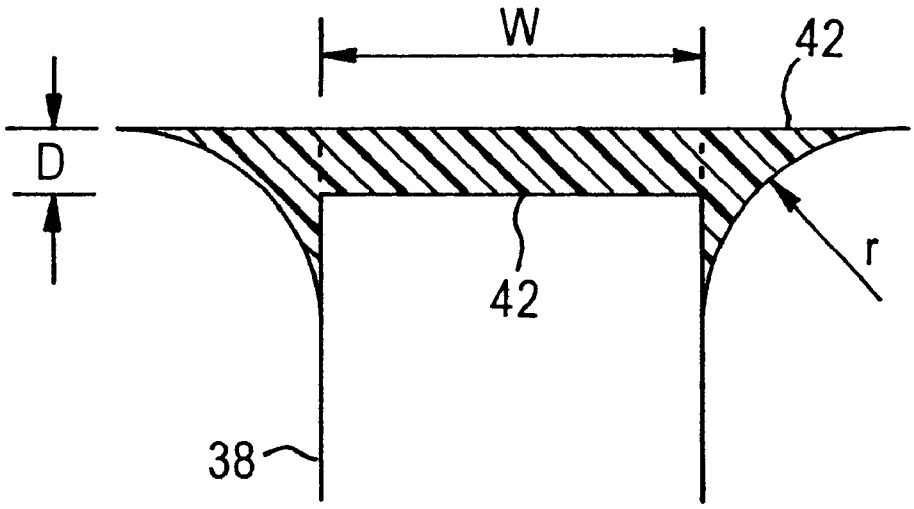
FIG. 7 illustrates the amount of applied adhesive.

The amount of applied adhesive 42 is described below with reference to FIG. 7. The width of the piezo-actuator 38 is designated W, the final thickness of the adhesive applied between the piezo-actuator 38 and the panel 40 is designated D, and the radius of the shaped curved surface of the extruded adhesive 42 is designated r. The amount of adhesive per unit length initially applied to piezo-actuator 38 can be expressed as $[2(4-\pi)r^2+4DW]/4W$.

Figures 8A, 8B, 8C, 8D:
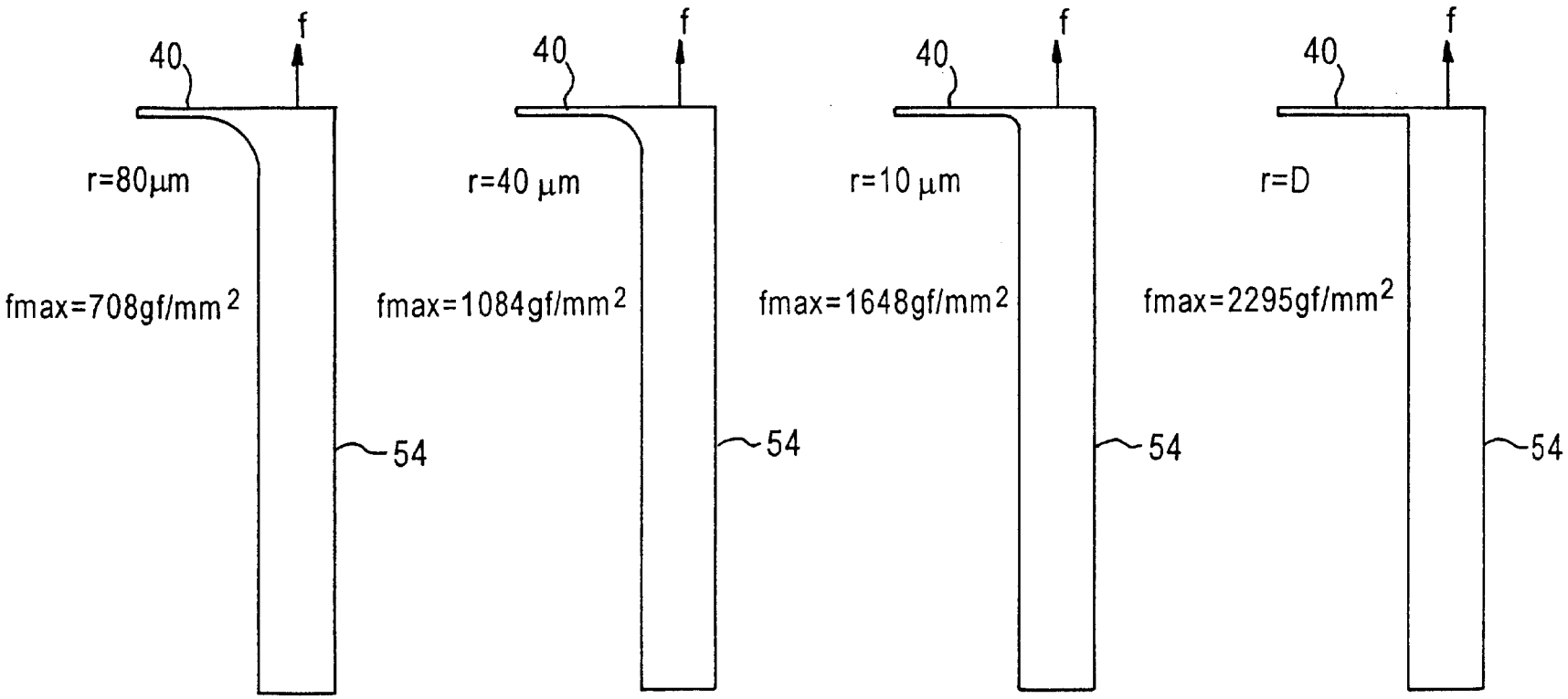
FIGS. 8(*a*)–8(*d*) show the relationship between the radius of curvature and the maximum tension when a predetermined force acts upon the panel.

The radius r for the shaped curved surface 52 of the adhesive 42 was variously set at 80, 40, 10 and 0 $\mu$m. The maximum tension generated in adhesive 42 was determined using the finite element method when a force of 100 gf/mm$^2$ was applied on panel 40 toward ink cavity 46. The results are shown in FIGS. 8(*a*)–8(*d*). As shown in FIG. 8(*d*), without the curved surface the maximum tension was 2,295 gf/mm$^2$. However, the maximum tension decreased in conjunction with the increase in the radius of the curved surface. Thus, when the radius of curvature r was 80 $\mu$m (FIG. 8 (*a*)), the maximum tension was 708 gf/mm$^2$ (about ⅓ the maximum tension without curvature).

Continuous operation durability tests were conducted when the adhesive 42 extruded from between the piezo-actuator 38 and the panel 40 was not shaped into a curved surface, and when adhesive was not extruded from between these members. These durability tests were performed by confirming the occurrence or lack thereof of separation of the panel at predetermined intervals until 1,000,000,000 oscillations ($10^9$) were attained, and checking the number of oscillations (number of oscillations of drive durability) when the moment of separation occurred. The adhesive used was epoxy AZ-15 (Ciba-Geigy).

FIGS. 9(*a*) and 9(*b*) are Tables that show the results of the continuous durability tests. In the tables, [E+n] represents $10+^n$, e.g., E+08 is $10+^8$, and E−03 is $10-^3$. The voltage and frequency applied between the electrodes was 30 V, 4 KHz.

As shown in FIG. 9(*b*), at a thickness of 5 $\mu$m without extruded adhesive, the panel separated at 2,400,000 continuous oscillations. It was necessary to have an adhesive thickness of 50 $\mu$m or more to prevent separation of the panel prior to the target of 1,000,000,000 oscillations.

On the other hand, when the adhesive was extruded but not shaped into a curved surface, the durability could be improved by enlarging the cross section area of the extrusion, as shown in FIG. 9(*a*). Separation of the panel wall could be prevented for the 1,000,000,000 continuous oscillations, when the adhesive thickness was 5 $\mu$m and the extrusion cross section area was set at about $1.0\times10^{-2}$ (mm$^2$) or more. However, when the extruded adhesive was shaped as a curved surface, e.g., having an adhesive thickness of 5 $\mu$m and radius of curvature of 25 $\mu$m or more, separation of the panel could be prevented prior to the target of 1,000,000,000 continuous oscillations. In particular, the durability was remarkably better with a shaped extruded adhesive compared to when the extruded adhesive was not shaped.

Figure 10:
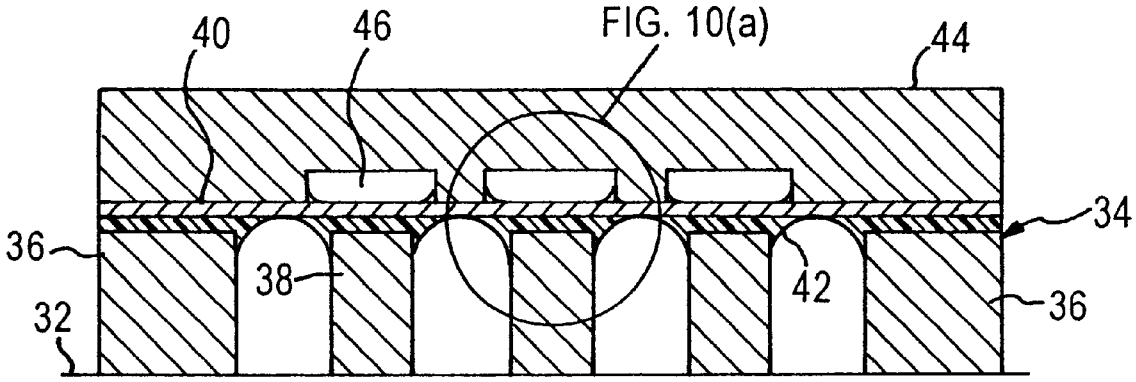
FIG. 10 is a section view of an inkjet recording head of another embodiment of the present invention including an enlarged sectional view of a portion of the section view.
Figure 10A:
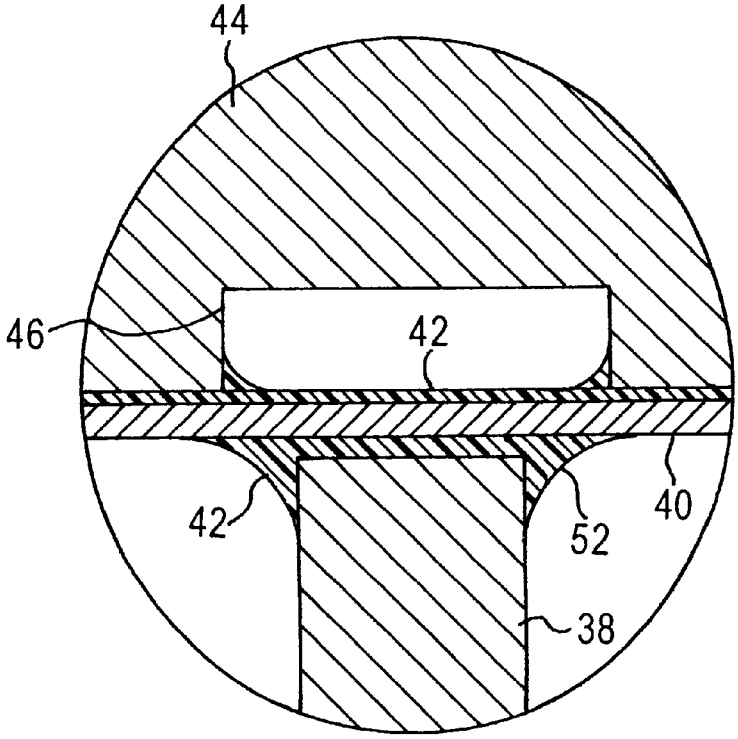

Although the preceding examples have been described in terms of adhesive applied between a piezo-actuator 38 and a panel 40, adhesive may be applied between a panel 40 and the head unit or channel plate 44, as shown in FIG. 10. Similar effectiveness can be obtained by extruding the adhesive from between these two members, and applying vibration or centrifugal force to shape the extruded adhesive into a curved surface.

In the description that follows, like parts are designated by like reference numbers and are not described in further detail.

Figure 11:
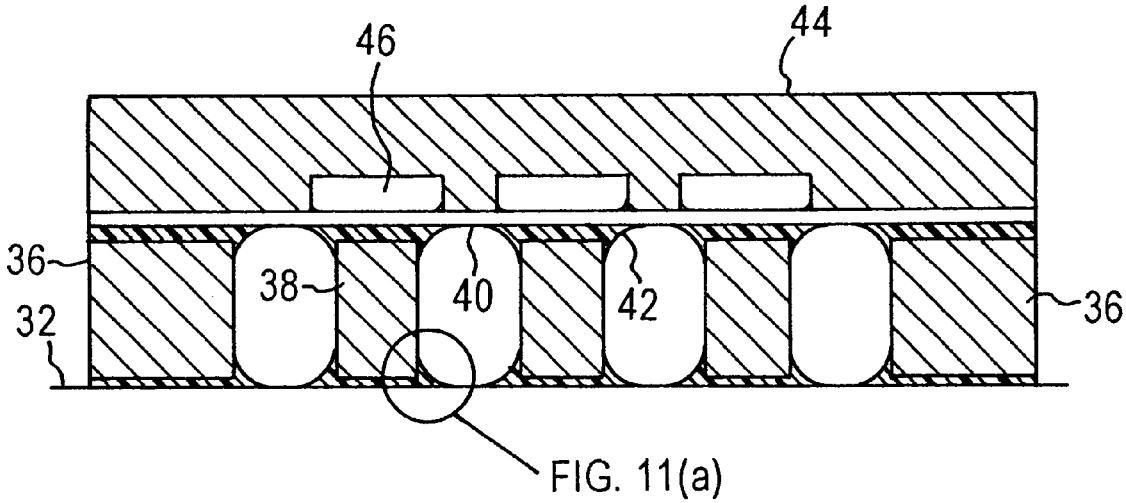
FIG. 11 is a section view of an inkjet recording head of another embodiment of the present invention including an enlarged sectional view of a another portion of the section view.
Figure 11A:
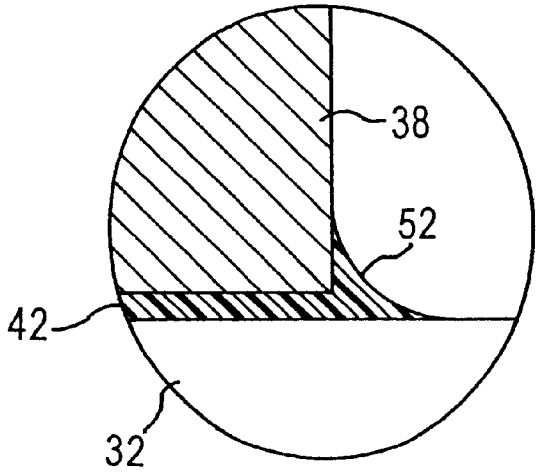

As shown in FIG. 11, the bonding of a piezoactuator 38 and substrate 32 may be accomplished to form an ink recording head by fixedly attaching a piezoactuator 38 and substrate 32 by using an adhesive 42, or by partially adhering these members with local applications of the adhesive 42.

Figure 12:
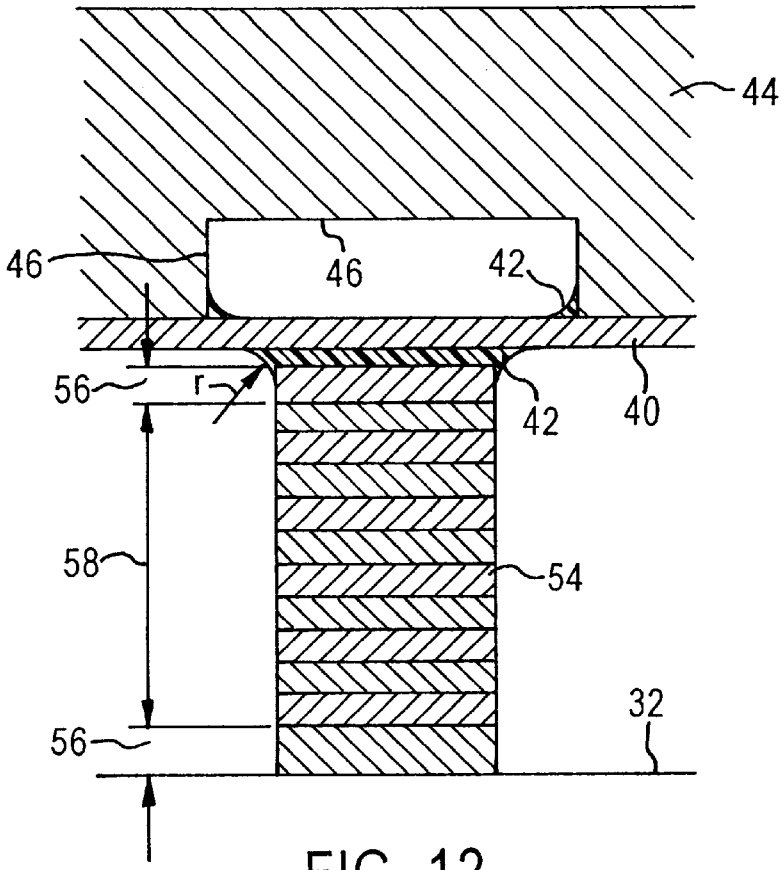
FIG. 12 is a partial section view of an inkjet recording head of still another embodiment of the present invention.

As shown in FIG. 12, in the case of a laminate type piezo-actuator 54, it is desirable that the radius of curvature r of the adhesive 42, extruded between piezo-actuator 54 and panel 40, is smaller than the thickness of the final exterior layer, i.e., inactive layer 56, opposite panel 40, so as to not have the extruded adhesive 42 adhere to an active layer 58. Consequently, there is no restriction in the deformation of the piezo-actuator 54 by the adhesive attached to an active layer after the adhesive has hardened. It is further desirable that piezo-actuator 54 and substrate 32 be similarly bonded.

Although the preceding embodiments have been described using a recording head wherein a panel 40 is deformed in conjunction with the deformation of piezo-actuator 38 to apply pressure on ink held in an ink cavity 6, alternate arrangements are contemplated. For example, the present invention may be applied to the bonding of a substrate to fixedly attach a piezo-actuator to a piezo-actuator in a recording head, wherein a piezo-actuator is arranged within an ink cavity, which is not provided with a panel. In this arrangement, the ink can be discharged by direct pressure of the piezo-actuator in conjunction with the oscillation of said piezo-actuator. In another variation, the panel 40 can be a thin film.

Figure 13A:
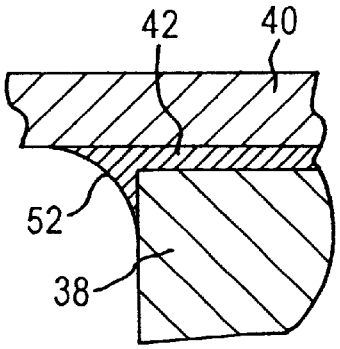
FIGS. 13(*a*) and 13(*b*) show a modification of the shaped curved surface of the adhesive.
Figure 13B:
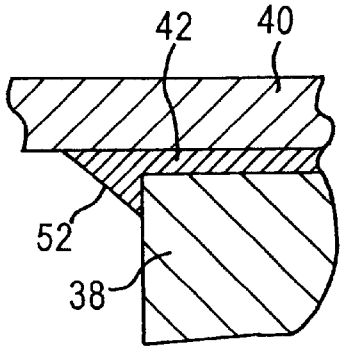

Further, although an extruded adhesive was shaped to form a curved surface in the aforesaid embodiments, the adhesive may be shaped in a plurality of shapes. For example, as shown in FIG. 13(*a*), a multi-angular shape may be formed. Or as shown in FIG. 13(*b*), a linear shape may be formed.

Furthermore, although an adhesive was applied to a piezo-actuator, which was subsequently pressed against a panel to extrude adhesive from between the bonding surfaces in the above description, as a variation, the adhesive may be applied to the panel beforehand.

Of course, it should be understood that a wide range of changes and modifications can be made to the preferred embodiment described above and that the foregoing description be regarded as illustrative rather than limiting. It is therefore intended that it is the following claims, including all equivalents, which are intended to define the scope of this invention.

What is claimed is:

1. An inkjet recording head comprising:

an inkjet head unit that includes at least one ink cavity for holding ink;

a mounting member having a first surface attached to said inject head unit and a second surface, opposed to the first surface;

an oscillating member for applying pressure to said at least one ink cavity by oscillating said mounting member, said oscillating member having at least one surface attached to said second surface of said mounting member;

an ink discharge port for discharging ink held in said at least one ink cavity; and an adhesive layer for fixedly attaching said oscillating member to said mounting member, wherein the at least one surface of said oscillating member and the second surface of said mounting member are attached by said adhesive layer, said adhesive layer includes a chamfered shaped portion for attaching the at least one surface of said oscillating member to said second surface of said mounting member, and said chamfered shaped portion has an outer surface, a portion of which has no direct contact with either said at least one surface of said oscillating member or said second surface of said mounting member.

2. The inkjet recording head of claim 1, wherein said oscillating member comprises a piezoelectric element that deforms in accordance with an applied voltage.

3. The inkjet recording head of claim 2, wherein said oscillating member further comprises a thin film in contact with said piezoelectric element that deforms in accordance with an applied voltage.

4. The inkjet recording head of claim 1, wherein the chamfered shaped portion of said adhesive layer is curved.

5. The inkjet recording head of claim 1, wherein the chamfered shaped portion of said adhesive layer is multi-angular.

6. The inkjet recording head of claim 1, wherein each ink cavity of said at least one ink cavity for holding ink includes a cutout formed in a surface of the inkjet head unit facing the first surface of said mounting member, wherein the first surface of the mounting member attached to the inkjet head unit covers each ink cavity of said at least one ink cavity for holding ink, wherein the first surface of the mounting member and the surface of the inkjet head unit having a cutout are attached by a second adhesive layer, and wherein said second adhesive laver includes a chamfered shaped portion for attaching side surfaces of said cutout to said first surface of said mounting member.

7. The inkjet recording head of claim 6, further comprising:

a substrate having a surface attached to another surface of said oscillating member, the other surface of said oscillating member being opposite to the surface of said oscillating member attached to said second surface of said mounting member, wherein the other surface of said oscillating member and said substrate member are attached by a third adhesive layer, and wherein said third adhesive layer includes a chamfered portion for attaching said other surface of said oscillating member to said substrate member.

8. An inkjet recording head comprising:

a plate for forming at least one ink cavity for holding ink in the inkjet recording head;

an oscillating member for applying pressure to said at least one ink cavity, said oscillating member including at least a main surface opposed to an attaching surface of said plate and side surfaces adjacent to said main surface, said oscillating member having predetermined surfaces attached to the plate; and an ink discharge port for discharging ink held in said at least one ink cavity; and an adhesive layer for fixedly attaching said predetermined surfaces of said oscillating member to said attaching surface of the plate, wherein said adhesive layer has a chamfered shaped portion for attaching the side surfaces of said oscillating member to said attaching surface of the plate, and said chamfered shaped portion has an outer surface, a portion of which has no direct contact with either said side surfaces of said oscillating member or said attaching surface of the plate.

9. The inkjet recording head of claim 8, further comprising:

a substrate attached by a second adhesive layer to a surface of the oscillating member opposite to the surface of said oscillating member adhered to said surface of said plate by said adhesive layer, wherein said second adhesive layer has a chamfered portion attaching said side surfaces of said oscillating member and said substrate member.

10. An inkjet recording head apparatus comprising:

at least one ink holding cavity;

an ink discharge port for discharging ink held in said at least one ink holding cavity;

a panel having a first and second surface, said first surface connected to said at least one ink holding cavity;

a driver including a main surface opposed to said second surface of said panel and side surfaces adjacent the main surface, said driver having a first portion connected to said second surface of said panel, said driver pressing against said panel to thereby cause ink to be discharged from said at least one ink holding cavity through said ink discharge port; and an adhesive layer for connecting said first portion to said second surface of said panel, wherein said first portion includes said side surfaces of said driver, said adhesive layer includes a chamfered shaped portion for connecting to said side surfaces and said second surface of said panel, and chamfered shaped portion has an outer surface, a portion of which has no direct contact with either said side surfaces of said driver or said second surface of said panel.

11. The inkjet recording head apparatus of claim 10, wherein said chamfered shaped portion of said adhesive layer h as a predetermined radius of curvature.

12. The inkjet recording head apparatus of claim 11, wherein said predetermined radius of curvature is at least 25 $\mu$m.

13. The inkjet recording head apparatus of claim 10, wherein said driver comprises at least two piezo-electric actuators, each piezo-electric actuator corresponding to a corresponding single ink holding cavity and being connected to said second surface of said panel at a position opposite to said corresponding single ink holding cavity.

14. The inkjet recording head apparatus of claim 13, wherein said each piezo-electric actuator is comprised of a plurality of layers.

15. An inkjet head comprising:

a unit internally having a space, said space being for accommodating ink therein, said unit having an outer surface;

a mounting member having a first surface attached to the outer surface of said unit and a second surface, opposed to the first surface;

a piezoelectric member having a at least a first surface and side surfaces adjacent to the first surface; and an adhesive layer for fixedly attaching the first surface and the side surfaces of said piezoelectric member to said second surface of said mounting member, said adhesive layer including a chamfered shaped portion for attaching the side surfaces of said piezoelectric member to said second surface of said mounting member, wherein said chamfered shaped portion has an outer surface, a portion of which has no direct contact with either said side surfaces of said piezoelectric member or said second surface of said mounting member.

16. The inkjet head of claim 15, wherein said unit comprises a member with a concave portion and the first surface of said mounting member covers the concave portion.

17. The inkjet recording head of claim 15, wherein the chamfered shaped portion of said adhesive layer is curved.

18. The inkjet recording head of claim 15, wherein the chamfered shaped portion of said adhesive layer is multi-angular.

19. The inkjet recording head of claim 15, wherein said unit has a plurality of spaces for accommodating ink therein, the inkjet recording head further comprising:

a plurality of piezoelectric members, each piezoelectric member corresponding to one space of the plurality of spaces, and said adhesive layer attaches each piezoelectric element to the corresponding space.

20. The inkjet recording head of claim 19, wherein said adhesive layer has a plurality of chamfered shaped portions, each chamfered shaped portion being located at the location where said each piezoelectric member is attached to the corresponding space.

21. The inkjet recording head of claim 15, wherein said unit has a plurality of spaces for accommodating ink therein; the inkjet recording head further comprising:

a plurality of piezoelectric members, each piezoelectric member corresponding to one space of the plurality of spaces; and a plurality of adhesive layers, each adhesive layer attaching a corresponding piezoelectric element to a respective space.

22. The inkjet recording head of claim 21, wherein each adhesive layer has a corresponding chamfered shaped portion at the location where said each piezoelectric member is attached to the corresponding space.

* * * * *